US007789818B2

(12) United States Patent
Gruber-Nadlinger et al.

(10) Patent No.: US 7,789,818 B2
(45) Date of Patent: Sep. 7, 2010

(54) ROTARY PART

(75) Inventors: Thomas Gruber-Nadlinger, Langenrohr (AT); Benno Bader, Neunkirchen (AT); Norbert Gamsjaeger, Bad Fischau (AT); Georg Gobec, Neustadt (AT); Herbert Schrefl, Peolten (AT)

(73) Assignee: Voith Patent GmbH, Heidenheim (DE)

( * ) Notice: Subject to any disclaimer, the term of this patent is extended or adjusted under 35 U.S.C. 154(b) by 430 days.

(21) Appl. No.: 11/564,036

(22) Filed: Nov. 28, 2006

(65) Prior Publication Data

US 2008/0205867 A1 Aug. 28, 2008

Related U.S. Application Data

(63) Continuation of application No. PCT/EP2005/051812, filed on Apr. 22, 2005.

(30) Foreign Application Priority Data

May 29, 2004 (DE) ..... 10 2004 026 535

(51) Int. Cl.
*B05C 1/08* (2006.01)

(52) U.S. Cl. ..... 492/9; 492/6; 492/47; 492/27

(58) Field of Classification Search ..... 492/6, 492/7, 9, 16, 17, 27, 48, 47
See application file for complete search history.

(56) References Cited

U.S. PATENT DOCUMENTS 242,058 A * 5/1881 Schurmann ..... 492/6
1,609,377 A * 12/1926 Millspaugh ..... 474/197
2,676,387 A * 4/1954 Mcarn ..... 492/15
3,161,125 A * 12/1964 Hornbostel ..... 100/155 R
3,662,446 A * 5/1972 Walls ..... 492/50
3,672,018 A * 6/1972 Junk et al. ..... 492/7
3,678,846 A * 7/1972 Bjorkegren ..... 100/155 R
3,750,246 A * 8/1973 Pessen ..... 492/6
3,969,801 A * 7/1976 Dolenc et al. ..... 492/7
4,158,128 A * 6/1979 Evdokimov et al. ..... 219/469
4,253,392 A * 3/1981 Brandon et al. ..... 100/155 R
4,305,191 A * 12/1981 Enomoto ..... 492/7
4,372,205 A 2/1983 Pflaum ..... 101/153
4,438,695 A * 3/1984 Maier et al. ..... 101/153
4,487,122 A * 12/1984 George et al. ..... 101/153

(Continued)

FOREIGN PATENT DOCUMENTS

DE 37 00596 1/1987

(Continued)

*Primary Examiner*—Essama Omgba
(74) *Attorney, Agent, or Firm*—Taylor IP, P.C.

(57) ABSTRACT

A rotary part, in particular a spreader roller for a web-processing machine has a supporting core with a longitudinal axis, said supporting core being mounted at its two longitudinal ends, and having an elastically flexible outer sleeve which surrounds the supporting core in its circumferential direction and extends, in at least some sections, between the two longitudinal ends of the supporting core. The outer sleeve on the supporting core is non-displaceably mounted on at least one bearing and that the outer sleeve is mounted on at least one displacing point at a distance from the bearing so as to be displaceable perpendicular to the longitudinal axis of the supporting core in order for the curvature of the outer sleeve to be adjustable.

34 Claims, 4 Drawing Sheets

U.S. PATENT DOCUMENTS

| | | | | |
|---|---|---|---|---|
| 4,663,809 | A | 5/1987 | Joutsjoki | 29/116 AD |
| 4,813,258 | A * | 3/1989 | Ginzburg | 72/243.6 |
| 6,038,906 | A * | 3/2000 | Hartung et al. | 72/241.8 |
| 6,409,645 | B1 * | 6/2002 | Paasonen et al. | 492/56 |
| 6,524,227 | B1 | 2/2003 | Isometsä et al. | 492/7 |
| 6,935,993 | B2 * | 8/2005 | Grabscheid et al. | 492/20 |

FOREIGN PATENT DOCUMENTS

| | | | |
|---|---|---|---|
| DE | 199 40 424 | | 8/1999 |
| DE | 200 05 499 | | 3/2000 |
| JP | 07092806 | A * | 4/1995 |

* cited by examiner

ROTARY PART

CROSS REFERENCE TO RELATED APPLICATIONS

This is a continuation of PCT application No. PCT/EP2005/051812, entitled "ROTARY PART", filed Apr. 22, 2005.

BACKGROUND OF THE INVENTION

1. Field of the Invention

This invention relates to a rotary part, in particular a spreader roller for a web-processing machine.

2. Description of the Related Art

Spreader rollers are used in web-processing machines to prevent fold formation or sagging on moving material webs by spreading the material webs. Also, spreader rollers are used to enable material webs that are arranged side by side and parallel with each other to run apart laterally. Material webs arranged side by side and parallel with each other can be produced by slitting a wide material web for example.

The spreader rollers known from the prior art usually have a curved and upright core on which several mutually independent roller segments are supported by way of roller bearings in order to simulate a curved roller in several sections.

The previously mentioned spreader rollers are complex in their construction and in their maintenance. Furthermore, on the previously mentioned spreader rollers the curvature is not adjustable.

From U.S. Pat. No. 6,524,227 there is known in addition a spreader roller on which the outer sleeve has respectively one bearing rod fitted to each longitudinal end, each rod being mounted respectively on a so-called double bearing. As there is no connection between the two double bearings, the moment input during bending of the spreader roller must be absorbed by the supports as torsional moment. Simple fixing to the supports is thus impossible.

Furthermore, in the case of spreader rollers of this type, high forces are exerted on the bearing arrangement, which can lead to high wear of the bearing.

What is needed in the art is an improved rotary part, in particular an improved spreader roller.

SUMMARY OF THE INVENTION

The present invention is based on the idea of creating a rotary part, in particular a spreader roller, on which the angle of the displacement as well as the size of the displacement (curvature) can be effected independently of the supporting core.

A rotary part, in particular a spreader roller for a web-processing machine, according to the generic notion has a supporting core with a longitudinal axis. In this case the supporting core is supported at its two longitudinal ends. In addition, the generic rotary part has an elastically flexible outer sleeve, which surrounds the supporting core in its circumferential direction and extends, in at least some sections, between the two longitudinal ends of the supporting core.

In the case of the rotary part of the present invention, provision is made in addition for the outer sleeve on the supporting core to be mounted on at least one bearing. In this case the outer sleeve is mounted on the bearing such that the outer sleeve cannot be displaced perpendicular to the longitudinal axis of the supporting core.

Furthermore, the outer sleeve is mounted on at least one displacing point so as to be displaceable perpendicular to the longitudinal axis of the supporting core, wherein the displacing point along the longitudinal axis of the supporting core is set apart from the bearing. Hence the curvature of the outer sleeve is adjustable. Furthermore, the outer sleeve between the bearing and the displacing point is constructed to be elastically deformable in at least some sections.

It is thus possible through relative displacement of the outer sleeve in relation to the supporting core at the displacing point to bring the outer sleeve into a position relative to the supporting core such that the longitudinal axes of the outer sleeve and the supporting core do not coincide at the displacing point and such that the longitudinal axes of the outer sleeve and the supporting core coincide at the bearing. To permit bending of the outer sleeve between the displacing point and the bearing, the outer sleeve is constructed to be elastically deformable in at least some sections.

As the result, the longitudinal axis of the outer sleeve between the bearing and the displacing point is curved relative to the longitudinal axis of the supporting core.

In this connection, displaceability and non-displaceability perpendicular to the longitudinal axis of the supporting core means that the displacement has a component which extends perpendicular to the longitudinal axis of the supporting core at the displacing point or bearing.

The outer sleeve between the bearing and the displacing point is constructed in this case in one piece.

In this connection, constructed in one piece means that the outer sleeve is formed by a continuous material section (either from a single casting or from several material sections joined together) and not by several material sections that are not connected to each other.

The result is a rotary part, in particular a spreader roller, on which the disadvantages known from the prior art are eliminated.

It is also possible, of course, for the outer sleeve to have a displacing component parallel to the longitudinal axis of the supporting core. The outer sleeve can then be compressed in its longitudinal direction, thus enabling a different bending line to be obtained.

According to an embodiment of the present invention, provision is made for two displacing points between which the bearing is arranged. It is thus possible to curve the outer sleeve on both sides of the bearing.

According to an embodiment of the present invention, provision is made for the outer sleeve to have one displacing point respectively at its two longitudinal ends. If provision is made in this case for the bearing to be in the middle region of the longitudinal extension of the outer sleeve, then the outer sleeve can be bent symmetrically in relation to the bearing.

According to another embodiment of the present invention, the outer sleeve is rotatably connected to the supporting core at the bearing such that the outer sleeve is rotatably mounted on the supporting core. In this case the rotatable bearing arrangement can be effected by rolling bearings or sliding bearings. As sliding bearings it is possible to use hydrodynamic or hydrostatic sliding bearings or air bearings for example.

The above mentioned feature is an advantage in particular, but not only, when the supporting core is not rotatable about its own longitudinal axis.

According to another embodiment of the present invention, the outer sleeve is non-rotatably connected to the supporting core at the first supporting point. This means that a rigid connection between the outer sleeve and the supporting core is created in order to enable the transmission of torque between the supporting core and the outer sleeve and to secure the outer sleeve against shifting in the longitudinal direction relative to the supporting core. The non-rotatable connection between the supporting core and the outer sleeve can be produced by gluing or mechanical bonding for example.

The above mentioned embodiment is essentially usable when the supporting core is rotatable about its longitudinal axis.

Another embodiment of the present invention provides in addition for at least one supporting point fitted to the outer sleeve or the supporting core and arranged in the longitudinal direction between the bearing and the displacing point, on which the supporting core or the outside sleeve can be brought to rest when the outer sleeve is curved. With the at least one supporting point it is possible to influence the curvature line or bending line of the outer sleeve relative to the supporting core because the minimum distance between the outer sleeve and the supporting core during bending of the outer sleeve is defined by the bearing point. During rotation of the curved outer sleeve, a relative movement between the supporting core and the outer sleeve arises in the region of the second supporting points regardless of whether the supporting core is non-rotatably or rotatably connected to the outer sleeve at the bearing. Hence, it is necessary for the supporting core and the outer sleeve to be rotatably connected here to each other.

In this case the rotatable bearing arrangement can be effected by angle-adjustable rolling bearings or sliding bearings.

According to another embodiment of the present invention, provision is made for the second supporting points to be arranged on both sides of the bearing and between the two displacing points in the longitudinal direction. It is thus possible to establish a curvature of the outer sleeve extending symmetrical to the bearing. By supporting the outer sleeve on a multiplicity of supporting points on both sides of the bearing it is possible to influence very precisely the bending line of the outer sleeve relative to the supporting core.

The position of the outer sleeve relative to the supporting core can be established by, for example, two counter-rotatable eccentric disks which have an influence respectively on the displacing points arranged at the longitudinal ends. In this case the displacement at the displacing points and the non-displaceable bearing arrangement of the outer sleeve on the supporting core induces a moment on the bearing such that the outer sleeve is deformed in accordance with its bending line relative to the supporting core. Another possibility for the displaceable bearing arrangement is to use guides which are displaceable in two planes and can exert an influence respectively on the displacing points arranged at the longitudinal ends. It is also possible, however, for the curvature to be produced by a linear displacement and then to swivel the curved spreader roller around the longitudinal axis of the supporting core.

The adjustment can be actuated hydraulically, pneumatically, electrically or manually.

According to another embodiment of the present invention, the relative adjustment is effected by piezoelectric elements incorporated in the outer tube. The incorporated piezoelectric elements can be constructed in the form of piezo fibers for example. When the respective electric voltages are applied, the piezoelectric elements expand and contract at different points of the outer sleeve, causing the outer sleeve to bend.

There are various ways in which the supporting core can be constructed. According to another further aspect of the invention, the longitudinal axis of the supporting core extends straight. Given a straight supporting core it is possible not only for the supporting core to rotate about its own axis but also for the supporting core to be non-rotatable about its own axis.

Another embodiment of the invention provides in addition for the longitudinal axis of the supporting core to extend curved. With this version it is only possible for the supporting core to be non-rotatable about its own axis and for the rotatability of the outer sleeve to be effected by a rotatable bearing arrangement on the bearing.

To optimize the loadability of the core and to partly define the curvature path it is advantageous for the supporting core to have, in at least some sections, a cross-sectional shape that changes along its longitudinal axis, in particular for it to extend conically in at least some sections.

To minimize vibrations of the rotary part during operation it makes sense for the natural frequency of the supporting core to be as high as possible. Hence the modulus of elasticity and the supporting core mass must be as small as possible. Tests have revealed that natural vibrations during operation can be nearly entirely prevented when the supporting core is manufactured at least partly from a material with a modulus of elasticity in the range from 10 to 1000 GPa, preferably from 50 to 800 GPa, in particular preferably from 100 to 500 Gpa, and a density in the range from 0.5 to 3 g/cm3, preferably from 1.0 to 2.0 g/cm3, in particular preferably from 1.3 to 2.0 g/cm3.

Preferred materials for manufacturing the supporting core are the following, either alone or in combination: plastics and/or metallic materials and/or composites which are produced in sandwich design and/or in the form of the foams and/or in the form of honeycombs and/or from ceramic material, for example thermosprayed layers, in particular metals, metal oxides and/or thermosprayed plastics or sintered ceramics or the like.

A concrete embodiment of the invention provides for the supporting core to be constructed from a foam and/or honeycomb core which is covered at least in some sections by a fiber composite. To manufacture the supporting core in this case, a foam core is first produced with nearly any possible shape and is then covered by a fiber composite sleeve. The result is a supporting core with a large modulus of elasticity and a small dead weight, which can be realized easily and with nearly any shape.

According to another embodiment of the present invention, the outer sleeve has in its longitudinal direction a modulus of elasticity in the range from 0.5 to 1000 GPa, preferably from 10 to 700 GPa, in particular preferably from 50 to 200 GPa, wherein the modulus of elasticity of the supporting core is greater than the modulus of elasticity of the outer sleeve. The result is an outer sleeve which is as flexible as possible in the longitudinal direction. The smaller modulus of elasticity in the longitudinal direction of the supporting core can be obtained, for example, by the fibers in a fiber composite being oriented essentially in the circumferential direction of the supporting core.

In order for the circular section of the outer sleeve not to be flattened too intensively during drawing of the web and curving, it makes sense for the outer sleeve to be deformable in radial direction as little as possible. An embodiment of the present invention thus provides for the outer sleeve to have a modulus of elasticity in the radial direction that is greater than the modulus of elasticity in the longitudinal direction.

The bending line of the outer sleeve can be influenced by changing the material thickness of the outer sleeve such that different bending lines can be established depending on the requirements imposed on the rotary part, in particular the spreader roller. Accordingly, an embodiment of the present invention provides for the outer sleeve to have a changing material thickness and/or cross-sectional shape in its longitudinal direction at least in some sections. Other possible ways to influence the bending line of the outer sleeve are with the material orientation and/or with the chosen material combination.

The outer sleeve can be manufactured from a plastic and/or a metallic material and/or a fiber composite, either alone or in combination.

Furthermore, the outer sleeve is covered in at least some sections by a covering.

In this case the covering is manufactured from elastomer plastic and/or from thermoplastic material and/or from duroplastic material and/or from ceramic material, either alone or in combination.

To control the properties of the covering it is advantageous for the composition of the covering material to change continuously and/or discontinuously in axial direction and/or longitudinal direction.

A covering with a continuously changing material composition is, for example, a covering which has a continuously changing material composition in radial and/or axial direction, meaning a covering material which has no interfaces in its composition such as is the case with covering material with a layered construction for example. If the covering material has interfaces in its composition, this is referred to as a discontinuous material composition.

A covering material that can be cited by way of example is one which changes its composition in radial direction from a 100% duroplastic material continuously into a 100% elastomer material.

Another covering material that can be cited by way of example is one which is constructed from four layers that are arranged one above the other in radial direction. Similarly it is possible to select a construction made of one and/or more layers, for example 2, 3, 5 or more layers. In this case the first layer is an adhesive layer for connecting the covering to the outer sleeve, the second layer is a fiber composite layer, the third layer is an adhesive layer for connecting the second layer to the fourth layer, and the fourth layer is a ceramic function layer.

In the above example, the fiber composite layer is constructed from a resin component, a hardener component, a fiber component and, optionally, one or more filler components. In this case the resin component can contain epoxy resins, polyurethane resins, phenol-formaldehyde resins and/or cyanate ester resins. The fiber component can contain fibers of the following types, either alone or in blend: glass, carbon, aramide, boron, polypropylene, polyester, PPS PEEK, ceramic and/or carbides such as SiC. Filler components can contain carbides, metals or oxides.

In addition it is possible, for example in the case of a matrix material, for the ratio of resin and hardener component to change continuously.

Furthermore, the above embodiment is configured such that the material composition changes continuously or discontinuously in the longitudinal direction of the covering. This makes sense if the edge zones are exposed to greater stress for example. In this case the edge zones can be constructed from a more wear-resistant material than the other regions.

The surface of a spreader roller has to perform different tasks depending on the application. To be able to achieve the best possible spreading effect, the adhesion of the material web should be as good as possible, which in turn requires a rough surface of the covering. To minimize the inclination of the covering toward soiling, the surface of the covering should be as smooth as possible. Twenty tests have revealed that the best results are achieved when the surface of the covering has a roughness in the range from Ra=0.001 to 100 um, preferably Ra–0.001 to 50 um, in particular preferably Ra=0.03 to 20 um.

According to another embodiment of the present invention, the surface has, in at least some sections, helically and/or radially arranged grooves and/or through-bores and/or blind bores. This form of embodiment creates grooves for removing air for example. The through-bores can also be evacuated.

To drive the rotary part, provision is made for the supporting core to be driven and the torque transmitted via the bearing to the outer sleeve which is non-rotatably connected to the supporting core. If the outer sleeve is rotatably connected to the supporting core, it makes sense for the outer sleeve to be driven directly by a V-belt drive or toothed-belt drive or chain drive or gear drive.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1B:
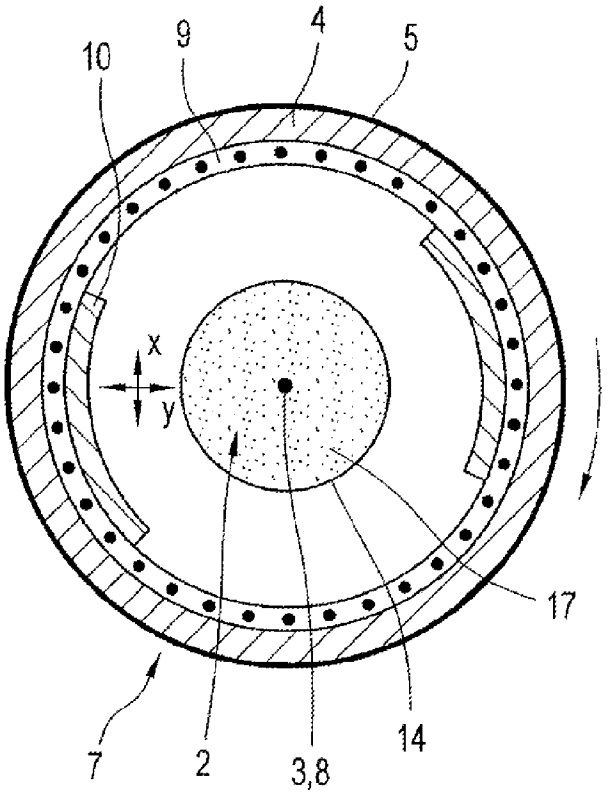
FIGS. 1A-1C show, in a cross-sectional view of the region of the bearing and the region of a supporting point and in a longitudinal view, a spreader roller of the invention in the non-curved state.
Figure 1A:
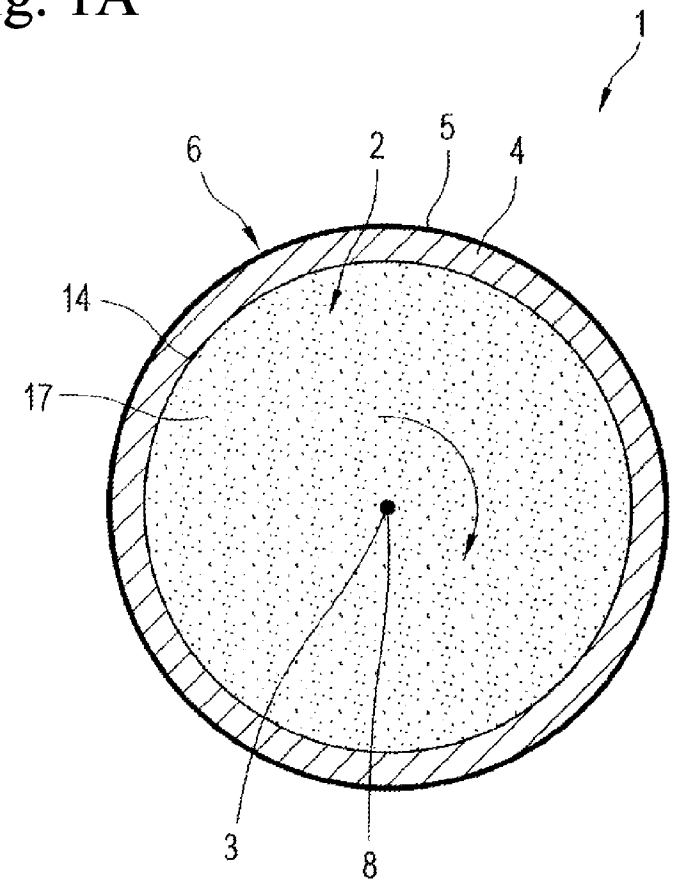
Figure 1C:
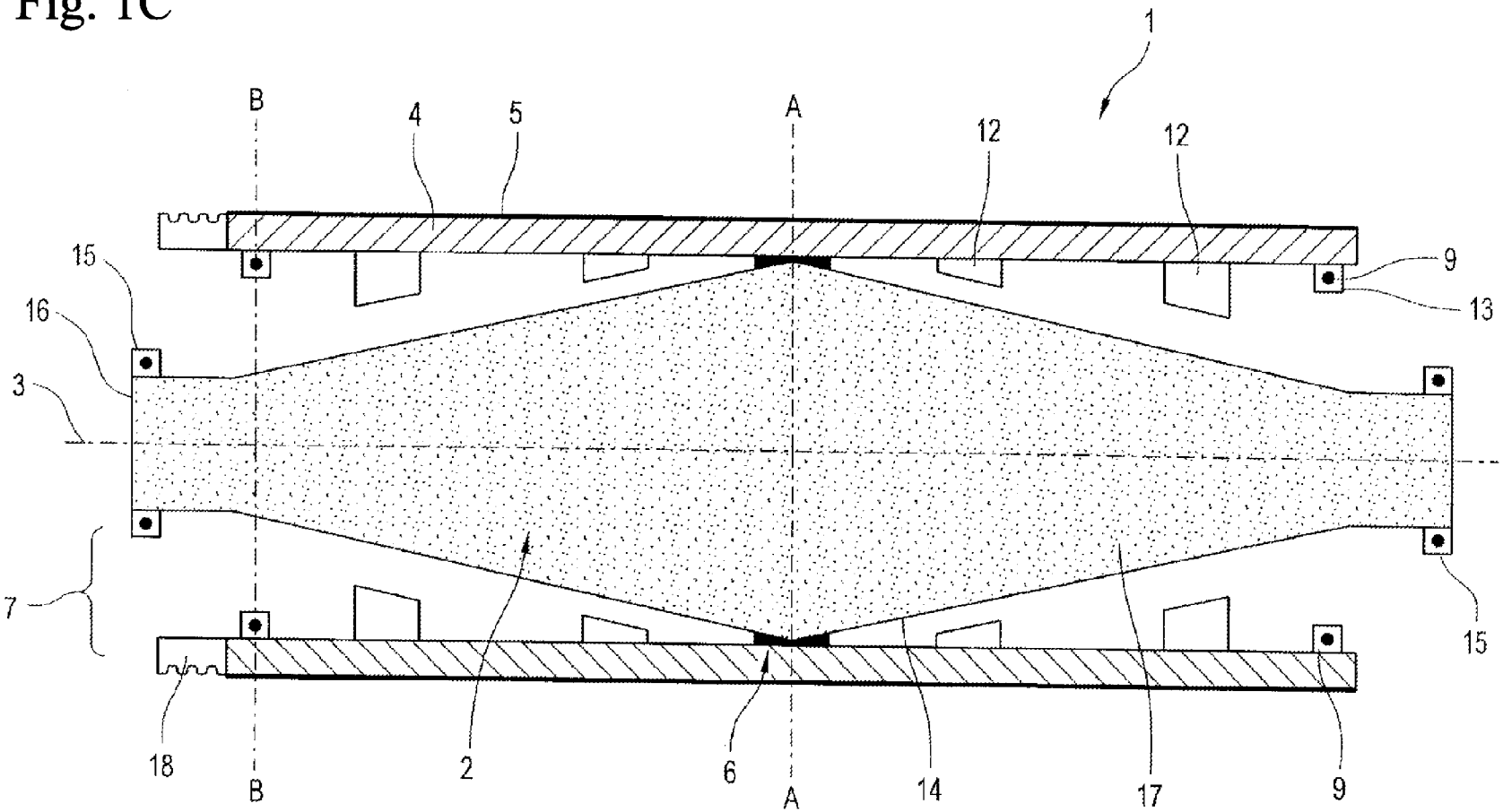

Referring now to the drawings, and more particularly to FIG. 1, there is shown, in a cross-sectional view of the region of the bearing 6 (FIG. 1*a*; section line A-A in FIG. 1*c*) and the region of a displacing point 7 (FIG. 1*b*; section line B-B in FIG. 1*c*) and in a longitudinal view (FIG. 1*c*), an inventive spreader roller 1 in the non-curved state.

The spreader roller 1 has a supporting core 2 with a longitudinal axis 3. The supporting core 2 is rotatable about a straight longitudinal axis 3. In this case the supporting core 2 is rotatably mounted on rolling bearings 15 in the region of its two longitudinal ends 16.

The supporting core 2 is surrounded in the direction of its longitudinal axis 3, in at least some sections, by an outer sleeve 4 with a covering 5. The outer sleeve 4 has a longitudinal axis 8 about which it can be rotated.

The supporting core 2 in the embodiment in question is constructed as a composite body with a foam core 17 and a fiber composite sleeve 14 surrounding the foam core.

In the embodiment in question, the outer sleeve is constructed as a hollow body.

As is evident from FIG. 1*c*, the supporting core 2 has a changing cross-sectional shape along its longitudinal axis, which tapers bilaterally from the section line A-A to the section line B-B.

In the embodiment in question, the outer sleeve 4 is manufactured as one piece from a flexible fiber composite material.

The covering 5 in the embodiment in question is constructed from four layers that are arranged one above the other in radial direction. In this case the first layer is an adhesive layer for connecting the covering 5 to the outer sleeve 4, the second layer is a fiber composite layer, the third layer is an adhesive layer for connecting the second layer to the fourth layer, and the fourth layer is a ceramic function layer forming the surface of the covering 5.

In the region of the bearing 6 (FIG. 1*a*) the outer sleeve 4 is non-rotatably and non-displaceably connected to the supporting core 2. The non-rotatable connection is produced by an adhesive connection. The longitudinal axis 3 of the supporting core 2 and the longitudinal axis 8 of the outer sleeve 4 always coincide in the region of the bearing 6, i.e. even in the curved state of the outer sleeve 4. The supporting core 2 and the outer sleeve 4 can thus be rotated together.

In the region of the displacing point 7, which in FIG. 1*b* is arranged in the region of a longitudinal end of the outer sleeve 4, the outer sleeve 4 is mounted by way of a rolling bearing 9 on a bearing arrangement 10 which is vertically displaceable relative to the longitudinal axis 3 of the supporting core 2 (the arrows in x and y direction illustrate the possible displacing directions of the bearing arrangement 10). Hence the outer sleeve 4 is rotatably mounted in relation to the bearing arrangement 10 and displaceably mounted in relation to the supporting core 2. In the non-curved state of the outer sleeve 4, the longitudinal axes 3 and 8 coincide as well in the two second supporting regions corresponding to the regions of the displacing points 7.

The bearing arrangement 10 can be adjusted in the x and y direction in this case by way of two spindle mechanisms which are offset by 90° to each other. The spindle mechanisms can be driven in this case by stepper motors which are controlled in turn by an electronic controller in order to be able to establish a variable roller curvature.

To be able to influence the bending line of the outer sleeve 4 in the curved state according to the requirements, supporting points 12 facing the supporting core 2 are arranged on the inside of the outer sleeve 4. The supporting points 12 define, in the case of a curved outer sleeve 4 in contact with the supporting core 12, the minimum distance between the outer sleeve 4 and the supporting core 2, as the result of which the bending line of the outer sleeve 4 is defined.

The bearing 6 is arranged centrally in the longitudinal extension of the outer sleeve 4. The supporting regions 12 are arranged on both sides of the bearing 6 in the longitudinal direction of the supporting core 2.

In the embodiment in question, the spreader roller is driven by way of a drive pulley 18 which is in linkage with a V-belt (not illustrated).

Figure 2B:
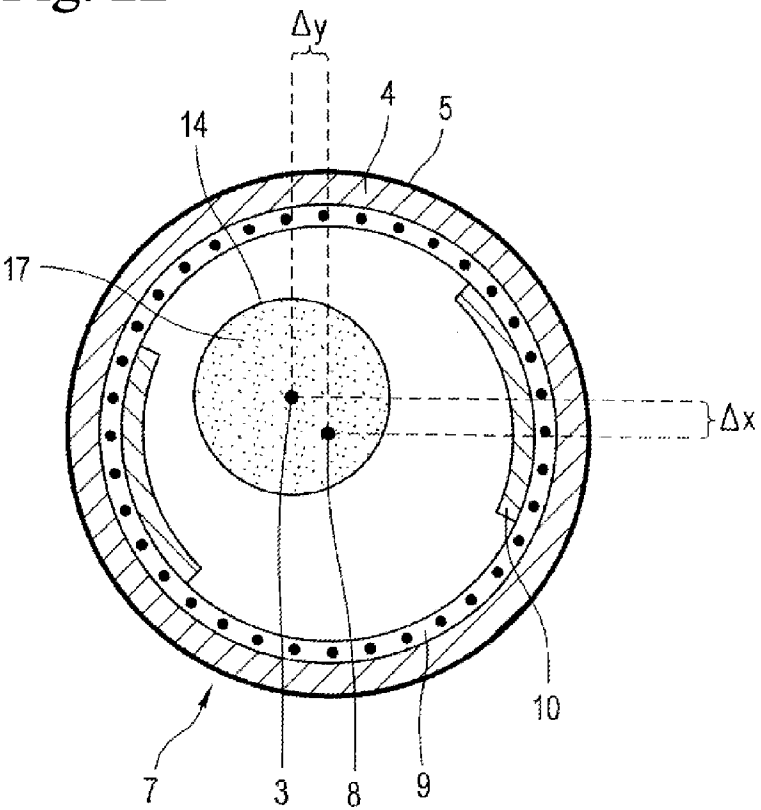
FIGS. 2A-2C show, in a cross-sectional view of the region of the bearing and the region of a supporting point and in a longitudinal view, a spreader roller of the invention in the curved state.
Figure 2A:
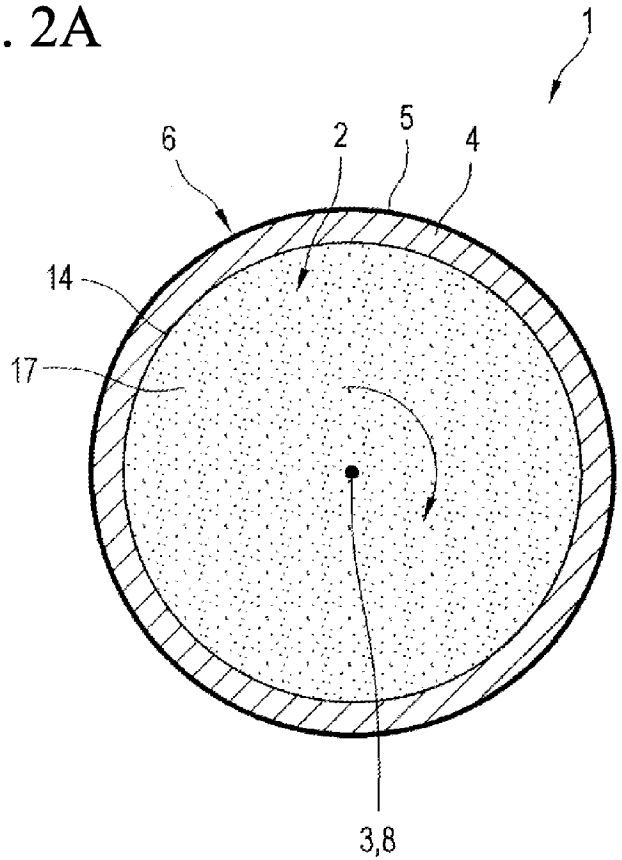
Figure 2C:
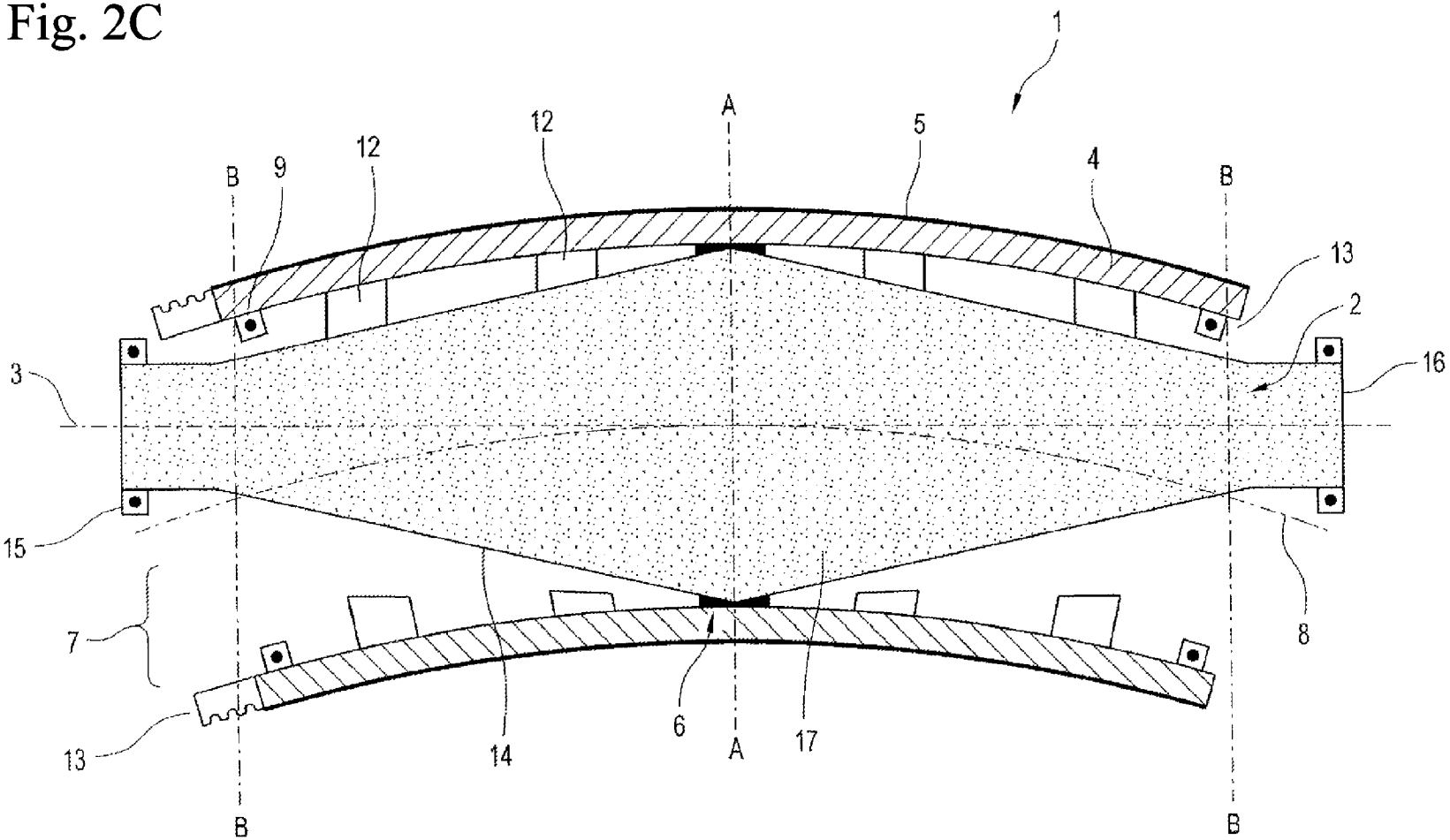

FIG. 2 shows, in a cross-sectional view of the region of the bearing 6 (FIG. 2*a*; section line A-A in FIG. 1*c*) and the region of the displacing point 7 (FIG. 2*b*; section line B-B in FIG. 2*c*) and in a longitudinal view (FIG. 2*c*), an inventive spreader roller 1 in the curved state.

In the region of the bearing 6 (FIG. 2*a*) the outer sleeve 4 is non-rotatably and non-displaceably connected to the supporting core 2. Hence, the relative position between the longitudinal axis 3 and the longitudinal axis 8 does not change in the region of the bearing 6 even in the curved state of the outer sleeve 4. The longitudinal axis 3 of the supporting core 2 and the longitudinal axis 8 of the outer sleeve 4 coincide accordingly in the region of the bearing 6.

In the region of the second supporting point 7, the two longitudinal axes 3 and 8 are offset by $\Delta x$ and $\Delta y$ to each other on account of the displaceable bearing arrangement 10 of the outer sleeve 4 relative to the supporting core 2. Therefore, on account of the non-displaceable bearing arrangement at the bearing 6 and the displacement by $\Delta x$ and $\Delta y$ at the second supporting regions 7 relative to the supporting core 2, the outer sleeve 4 is curved and displaced. As a result, the longitudinal axis 8 of the outer sleeve 4 is curved relative to the longitudinal axis 3 of the supporting core 2.

In the curved state of the outer sleeve 4 the supporting points 12 come to rest on the supporting core 2 and define the bending line of the outer sleeve 4 relative to the supporting core 2. The supporting regions 12 are displaceable in the circumferential direction of the supporting core 2 relative to the supporting core 2. Hence a kind of sliding bearing arrangement of the supporting core 2 on the outer sleeve 4 is formed at the other second supporting regions 12. To reduce the sliding resistance in the region of the other second supporting regions 12 it makes sense for the supporting core 2 to be equipped with a kind of sliding coating at these points.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

1 Spreader roller
2 Supporting core
3 Longitudinal axis (supporting core)
4 Outer sleeve
5 Covering
6 Bearing
7 Displacing point
8 Longitudinal axis (outer sleeve)
9 Rolling bearing (for outer sleeve)
10 Displaceable bearing
11 Elevation
12 Supporting point
13 Longitudinal end (outer sleeve)
14 Fiber composite sleeve
15 Rolling bearing (for supporting core)
16 Longitudinal end (supporting core)
17 Foam core
18 Drive pulley

What is claimed is:

1. A rotary part for a web-processing machine, said rotary part comprising:

a supporting core having a longitudinal axis and two longitudinal ends and defining a plurality of sections, said supporting core mounted at said two longitudinal ends;

at least one bearing;

an elastically flexible outer sleeve which surrounds said supporting core in a circumferential direction of said supporting core and extends, in at least some of said plurality of sections of said supporting core, between said two longitudinal ends of said supporting core, said outer sleeve on said supporting core non-displaceably mounted on said at least one bearing, said outer sleeve mounted on at least one displacing point at a distance from said bearing so as to be displaceable perpendicular to said longitudinal axis of said supporting core in order for a curvature of said outer sleeve to be adjustable, said supporting core being configured such that said longitudinal axis of said supporting core remains straight when said outer sleeve is displaced perpendicular to said longitudinal axis of said supporting core, said outer sleeve including a plurality of supporting points facing said supporting core and being spaced apart from said at least one bearing, said plurality of supporting points being configured for coming to rest on said supporting core and thereby for defining a bending line of said outer sleeve relative to said supporting core.

2. A rotary part according to claim 1, wherein said at least one displacing point includes two displacing points between which said bearing is arranged.

3. A rotary part according to claim 2, wherein said outer sleeve includes two longitudinal ends and has one displacing point respectively at said two longitudinal ends of said outer sleeve.

4. A rotary part according to claim 2, further comprising a plurality of supporting points, wherein said bearing includes at least two sides, said plurality of supporting points arranged on both said sides of said bearing in a longitudinal direction of said longitudinal axis of said supporting core and between said two displacing points.

5. A rotary part according to claim 2, further comprising at least one of a plurality of counter-rotatable eccentric disks and a plurality of guides displaceable in two planes, wherein said outer sleeve includes a relative adjustment relative to said supporting core, said relative adjustment established one of by said plurality of counter-rotatable eccentric disks which have an influence on said displacing points and by said plurality of guides which have an influence on said displacing points.

6. A rotary part according to claim 5, wherein said outer sleeve includes a plurality of piezoelectric elements which effects said relative adjustment.

7. A rotary part according to claim 1, wherein said outer sleeve is rotatably connected to said supporting core by said bearing.

8. A rotary part according to claim 1, wherein said supporting core is non-rotatable about said longitudinal axis of said supporting core.

9. A rotary part according to claim 1, wherein said outer sleeve is non-rotatably connected to said supporting core by said bearing.

10. A rotary part according to claim 1, wherein said supporting core is rotatable about said longitudinal axis of said supporting core.

11. A rotary part according to claim 1, further comprising at least one bearing point fitted to said outer sleeve or to said supporting core and arranged in a longitudinal direction of said longitudinal axis between said bearing and said displacing point, said outer sleeve defining a plurality of sections, said at least one bearing point being that on which one of said supporting core and said outer sleeve can be brought to rest, in at least some of said plurality of sections of one of said supporting core and said outer sleeve, when said outer sleeve is curved.

12. A rotary part according to claim 1, wherein said longitudinal axis of said supporting core extends straight.

13. A rotary part according to claim 1, wherein said supporting core has a cross-sectional shape that changes, in at least some of said plurality of sections of said supporting core, along said longitudinal axis of said supporting core.

14. A rotary part according to claim 13, wherein said supporting core has a cross-sectional shape that extends conically, in at least some of said plurality of sections of said supporting core, along said longitudinal axis of said supporting core.

15. A rotary part according to claim 1, wherein said supporting core comprises a material with a modulus of elasticity in a range from 10 to 1000 GPa and a density in a range from 0.5 to 3 g/cm$^3$.

16. A rotary part according to claim 1, wherein said supporting core comprises a material with a modulus of elasticity in a range from 50 to 800 GPa and a density in a range from 1.0 to 2.0 g/cm$^3$.

17. A rotary part according to claim 1, wherein said supporting core comprises a material with a modulus of elasticity in a range from 100 to 500 G pa and a density in a range from 1.3 to 2.0 g/cm$^3$.

18. A rotary part according to claim 1, wherein said supporting core comprises at least one of a plastic, a metallic material, and a fiber composite in at least one of a sandwich construction, a form of a plurality of foams, and a form of a plurality of honeycombs.

19. A rotary part according to claim 1, wherein said supporting core comprises at least one of a foam and a honeycomb core which is covered in at last some sections by a fiber composite.

20. A rotary part according to claim 1, wherein said outer sleeve includes a longitudinal direction and has in said longitudinal direction of said outer sleeve a modulus of elasticity in a range from 0.5 to 1000 GPa.

21. A rotary part according to claim 20, wherein said outer sleeve includes a radial direction and has a modulus of elasticity in said radial direction that is greater than said modulus of elasticity in said longitudinal direction of said outer sleeve.

22. A rotary part according to claim 1, wherein said outer sleeve includes a longitudinal direction and has in said longitudinal direction of said outer sleeve a modulus of elasticity in a range from 10 to 700 GPa.

23. A rotary part according to claim 1, wherein said outer sleeve includes a longitudinal direction and has in said longitudinal direction of said outer sleeve a modulus of elasticity in a range from 50 to 200 GPa.

24. A rotary part according to claim 1, wherein said supporting core includes a longitudinal direction and has at least one of a changing material thickness and a changing cross-sectional shape in said longitudinal direction in at least some of said plurality of sections of said supporting core.

25. A rotary part according to claim 1, wherein said outer sleeve includes a longitudinal direction and a plurality of sections and has at least one of a changing material thickness and a changing cross-sectional shape in said longitudinal direction of said outer sleeve in at least some of said plurality of sections of said outer sleeve.

26. A rotary part according to claim 1, wherein said outer sleeve comprises at least one of a plastic, a metallic material, and a fiber composite.

27. A rotary part according to claim 1, further comprising a covering, wherein said outer sleeve includes a plurality of sections and is covered in at least some of said plurality of sections of said outer sleeve by said covering.

28. A rotary part according to claim 27, wherein said covering comprises at least one of an elastomer plastic, a thermoplastic material, a duroplastic material, and a ceramic material.

29. A rotary part according to claim 27, wherein said covering includes an axial direction, a longitudinal direction, and a material composition which changes at least one of continuously and discontinuously in at least one of said axial direction and said longitudinal direction.

30. A rotary part according to claim 27, wherein said covering includes a surface having a roughness in a range from Ra=0.001 to 100 um.

31. A rotary part according to claim 27, wherein said covering includes a surface having a roughness in a range from Ra=0.001 to 50 um.

32. A rotary part according to claim 27, wherein said covering includes a surface having a roughness in a range from Ra=0.03 to 20 um.

33. A rotary part according to claim 27, wherein said covering includes a surface having a plurality of sections and, in at least some of said sections of said surface, at least one of a plurality of helically arranged grooves, a plurality of radially arranged grooves, a plurality of through-bores, and a plurality of blind bores.

34. A rotary part according to claim 27, wherein said outer sleeve is evacuated in at least some of said plurality of sections.

* * * * *